US008001758B2

(12) United States Patent
Morioka

(10) Patent No.: US 8,001,758 B2
(45) Date of Patent: Aug. 23, 2011

(54) RUBBER-PRODUCT-REINFORCING STEEL CORD AND METHOD FOR MANUFACTURING THE SAME

(75) Inventor: Noritaka Morioka, Ono (JP)

(73) Assignee: Tokusen Kogyo Co., Ltd., Ono (JP)

( * ) Notice: Subject to any disclaimer, the term of this patent is extended or adjusted under 35 U.S.C. 154(b) by 0 days.

(21) Appl. No.: 12/726,563

(22) Filed: Mar. 18, 2010

(65) Prior Publication Data

US 2010/0236211 A1 Sep. 23, 2010

(30) Foreign Application Priority Data

Mar. 18, 2009 (JP) ..... 2009-066156
Sep. 23, 2009 (JP) ..... 2009-218319

(51) Int. Cl.
*D02G 3/02* (2006.01)
*D02G 3/22* (2006.01)

(52) U.S. Cl. ..... 57/236

(58) Field of Classification Search ..... 57/200, 57/236, 239, 246; 152/451, 527, 556
See application file for complete search history.

(56) References Cited

U.S. PATENT DOCUMENTS 5,162,067 A * 11/1992 Miyawaki ..... 152/451
5,293,737 A * 3/1994 Kobayashi et al. ..... 57/236
5,319,915 A * 6/1994 Kobayashi et al. ..... 57/200
5,337,549 A * 8/1994 Kobayashi et al. ..... 57/236
5,687,557 A * 11/1997 De Vos et al. ..... 57/214
5,878,564 A * 3/1999 De Vos et al. ..... 57/311

FOREIGN PATENT DOCUMENTS

EP 363893 A2 * 4/1990
JP 05140882 6/1993

* cited by examiner

*Primary Examiner* — Shaun R Hurley
(74) *Attorney, Agent, or Firm* — Browdy and Neimark, PLLC

(57) ABSTRACT

A single-layered rubber-product-reinforcing steel cord with good rubber penetration properties, excellent fatigue resistance, and small low-load stretch is obtained. All of wires 11 are provided with curls having a substantially elliptical cross-section and a pitch smaller than that of curls for intertwining, formed by providing the wires with spiral curls and then pressing the wires. These wires are intertwined into each other to form a single-layered twist structure, and, thus, a cord is obtained in which a hollow portion at the center of the cord is in communication with an outside via a gap 12 between the wires 11, and at least any one pair of adjacent wires 11 are substantially in contact with each other at any point in the longitudinal direction of the cord.

2 Claims, 3 Drawing Sheets

RUBBER-PRODUCT-REINFORCING STEEL CORD AND METHOD FOR MANUFACTURING THE SAME

BACKGROUND OF THE INVENTION

1. Field of the Invention

The present invention relates to a rubber-product-reinforcing steel cord (hereinafter, this may be simply referred to as a "cord") used as a rubber-product-reinforcing material for an automotive tire, a conveyer belt, or the like, and a method for manufacturing the same.

2. Description of Related Art

As a single-layered rubber-product-reinforcing steel cord used as a rubber-product-reinforcing material for an automotive tire, a conveyer belt, or the like, conventionally, a cord is typically used that has a single-layered twist structure such as a 1×3 or a 1×5 structure, and that has a so-called closed-twist structure in which a plurality of wires are tightly intertwined in close contact with each other. However, in a cord having such a closed-twist structure, a closed space is formed at the center of the cord. When the cord is held between two rubber sheets and subjected to heat compression to form a composite sheet, rubber material does not penetrate the hollow portion at the center of the cord, and the composite has a structure in which the cord is merely enclosed by the rubber sheets. Thus, a so-called complete composite is not obtained in which the rubber material completely penetrates the hollow portion at the center of the cord and the rubber and the cord are integrated. Accordingly, when a composite sheet in which a conventional cord having such a closed-twist structure is held between rubber sheets and subjected to heat compression is combined into, for example, a tire of an automobile, adhesion between the rubber material and the cord is insufficient, and, thus, a so-called separation phenomenon is likely to occur in which the rubber material is separated from the cord during travel of the automobile. Furthermore, when water that has penetrated the rubber material reaches the hollow portion at the center of the cord, the water immediately spreads through the hollow portion in the longitudinal direction of the cord, and causes corrosion of the cord. As a result, a problem occurs in which the mechanical strength of the cord is significantly lowered.

Furthermore, a cord having an open-twist structure is known in which, as shown in FIG. 5, a curling process for intertwining is excessively performed on all of a plurality of wires 31 of a cord 30 having a single-layered twist structure, a gap 32 is formed between the wires 31, and rubber material easily penetrates the interior portion. However, in the case of a cord having such an open-twist structure, the wires are not in contact with each other, and, thus, the shape is easily deformed. Furthermore, the stretch in an extremely low load area (hereinafter, referred to as "low-load stretch") is large, and, thus, handling work efficiency is poor. Furthermore, due to the tensile force of an extremely low load applied while molding a composite sheet, the gap 32 becomes smaller, and the rubber material may not sufficiently penetrate the interior portion of the cord.

Furthermore, a configuration is proposed in which, as shown in FIG. 6, a wire 41 that is part of a plurality of wires 41 of a cord 40 having such a single-layered twist structure is provided with small spiral curls that are different from curls for intertwining (see JP H5-140882A, for example). This cord is obtained by tightly intertwining a wire that has small spiral curls that are different from curls for intertwining (hereinafter, referred to as a "spiral wire") and wires that have only curls for intertwining (hereinafter, referred to as "non-spiral wires"). Since the wires are brought into close contact and intertwined into each other, the shape is not deformed as in the case of a cord having a closed-twist structure, and a gap 42 is formed between the spiral wire and the non-spiral wires, so that the rubber material penetrates the interior portion.

However, when a tension load acts on a cord having such a single-layered twist structure in which only parts of the wires are provided with spiral curls in this manner, the tension load tends to be concentrated on the non-spiral wires.

Thus, it is also conceivable that, as shown in FIG. 7, all of wires 51 of a cord 50 having such a single-layered twist structure are formed into spiral wires. In this state, a gap 52 via which rubber material penetrates the interior portion is formed between the wires 51. Furthermore, since the tension load is divided among all of the wires, fatigue resistance is not lowered by the concentration of the tension load. However, when all of the wires 51 are formed into spiral wires in this manner, the low-load stretch of the cord 50 increases.

SUMMARY OF THE INVENTION

It is an object of the present invention to provide a rubber-product-reinforcing steel cord having a single-layered twist structure with good rubber penetration properties, excellent fatigue resistance, and small low-load stretch.

The present invention is directed to a rubber-reinforcing steel cord having a 1×n single-layered twist structure obtained by intertwining n wires, where n=3 to 6, with a same wire diameter, wherein all of the wires are provided with substantially elliptical spiral curls having a substantially elliptical cross-section and a pitch smaller than that of curls for intertwining, formed by providing the wires with spiral curls and then pressing the wires, and the substantially elliptical spiral curls have a curl pitch P of 0.32 Pc to 0.55 Pc, where Pc is a twist pitch in mm of a cord, and have a substantially elliptical cross-sectional shape with a minor axis D1/major axis D2 of 0.35 to 0.66.

Furthermore, the present invention is directed to a method for manufacturing a rubber-reinforcing steel cord having a 1×n single-layered twist structure obtained by intertwining n wires, where n=3 to 6, with a same wire diameter, comprising: providing all of the wires with spiral curls and then pressing the wires to provide the wires with substantially elliptical spiral curls having a substantially elliptical cross-section and a pitch smaller than that of curls for intertwining; wherein the substantially elliptical spiral curls have a curl pitch P of 0.32 Pc to 0.55 Pc, where Pc is a twist pitch in mm of a cord, and have a substantially elliptical cross-sectional shape with a minor axis D1/major axis D2 of 0.35 to 0.66; and intertwining the wires having the substantially elliptical spiral curls into each other to form a steel cord having a single-layered twist structure.

This cord is a cord obtained by intertwining wires in which all of the wires are provided with further substantially elliptical spiral curls having a pitch smaller than that of curls for intertwining. Accordingly, a cord after intertwining also has further curls having a pitch smaller than that of curls for intertwining, and, thus, a hollow portion at the center of the cord is in communication with the outside via a gap between the wires, and rubber material easily penetrates the interior portion.

Furthermore, in this cord, all of the wires have curls having a pitch smaller than that of curls for intertwining, and, when a tension load acts on the cord, the load acts equally on all of the wires, and, thus, the fatigue resistance is not lowered by concentration of the load on part of the wires, and excellent fatigue resistance is obtained. Furthermore, in this cord, at least any one pair of adjacent wires are substantially in contact with each other at any point in the longitudinal direction of the cord. Accordingly, the cord stretch is reduced, and the low-load stretch can be suppressed.

In the above-described configuration, the curl pitch P is 0.32 Pc to 0.55 Pc, where Pc is a twist pitch in mm of a cord. The reason for this is that, if the curl pitch P is less than 0.32 Pc, unnatural plastic deformation occurs where excessive stress acts during a curling process, and, thus, the wires are easily broken, and the productivity is lowered, and, if the curl pitch P is more than 0.55 Pc, the cord obtained by intertwining these wires has a reduced gap between the wires clue to a tensile force generated by the flow of the rubber material while molding a rubber product or by a frictional force applied to the surface of the cord, and, thus, the rubber material cannot sufficiently penetrate the interior portion. Furthermore, minor axis D1/major axis D2 of a cross-sectional shape of the substantially elliptical spiral curl is 0.35 to 0.66. The reason for this is that, if a cord is obtained by intertwining wires with a D1/D2 of less than 0.35, a gap between the wires is too small, and rubber material cannot sufficiently penetrate the interior portion during pressing and vulcanizing operations even when a rubber material with good flowability is used, and, if a cord is obtained by intertwining wires with a D1/D2 of more than 0.66, the twist stability becomes poor, and the fatigue resistance deteriorates.

In the above-described manufacturing method, wires may be processed such that, after the wires are provided with substantially elliptical spiral curls formed by providing the wires with spiral curls and then pressing the wires, the wires are once wound about a reel or the like, and a predetermined number of such wires are set at a supply apparatus of a twisting machine and intertwined into each other, or such that the wires are subjected to a curling process between from the supply apparatus to a twist port of the twisting machine.

According to the present invention, a rubber-product-reinforcing steel cord having a single-layered twist structure with good rubber penetration properties, excellent fatigue resistance, and small low-load stretch can be obtained. When this cord is used, for example, as a reinforcing material for an automotive tire, a tire that has excellent fatigue resistance and excellent rubber penetration properties can be produced without lowering handling work efficiency during tire manufacture. Moreover, the life of the tire can be significantly prolonged.

Furthermore, in this cord, wires before intertwining have a curl pitch P of 0.32 Pc to 0.55 Pc, where Pc is a twist pitch in mm of a cord. Thus, the occurrence of unnatural plastic deformation where excessive stress acts can be prevented during a curling process and the productivity can be increased. In the cord obtained by intertwining these wires, a gap between the wires can be prevented from being reduced by a tensile force generated by the flow of the rubber material while molding a rubber product or by a frictional force applied to the surface of the cord, and, thus, the rubber material sufficiently penetrates the interior portion. Furthermore, minor axis D1/major axis D2 of the substantially elliptical curl is 0.35 to 0.66, and, thus, in the cord obtained by intertwining these wires, the rubber material can sufficiently penetrate the interior portion during pressing and vulcanizing operations, twisting is stabilized, and deterioration in the fatigue resistance can be prevented.

DETAILED DESCRIPTION OF THE INVENTION

Hereinafter, a rubber-product-reinforcing steel cord according to an embodiment of the present invention will be described with reference to the drawings.

Exemplary Embodiment

Figure 1:
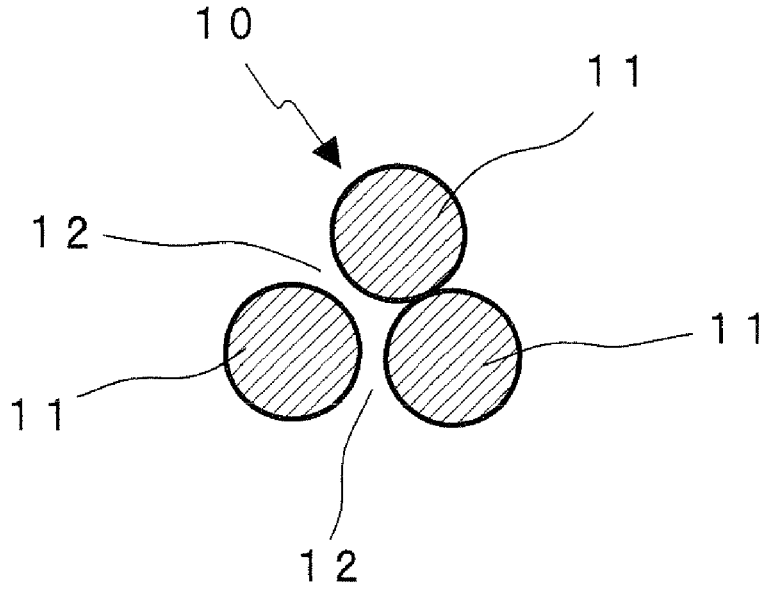
FIG. 1 is a cross-sectional view of a steel cord having a 1×3 single-layered twist structure according to an embodiment of the present invention.

FIG. 1 shows a cross-sectional structure of a steel cord having a 1×3 structure, as an example of the embodiment having a 1×n (n=3 to 6) single-layered twist structure.

A steel cord 10 shown in FIG. 1 has a 1×3 single-layered twist structure consisting of three wires 11 with the same wire diameter, and is obtained by intertwining the three wires. All of the wires 11 are provided with spiral curls having a substantially elliptical cross-section (hereinafter, referred to as "substantially elliptical spiral curls") and having a pitch smaller than that of the curls for intertwining, the spiral curls being formed by providing the wires with spiral curls and then pressing the wires.

In the cord 10, all of the wires 11 have not only curls for intertwining, but also substantially elliptical spiral curls having a pitch smaller than that of the curls for intertwining. The substantially elliptical spiral curls having a pitch smaller than that of the curls for intertwining are curls obtained by providing the wires with spiral curls, and then pressing the wires.

Figure 3:
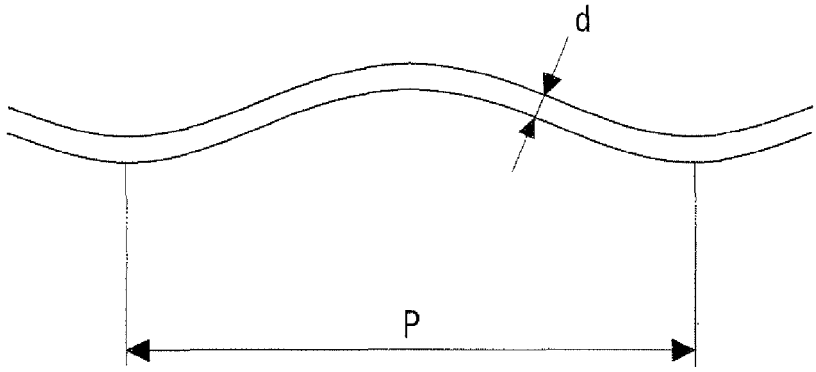
FIG. 3 is an explanatory view of the pitch of substantially elliptical spiral curls according to the embodiment of the present invention.
Figure 4:
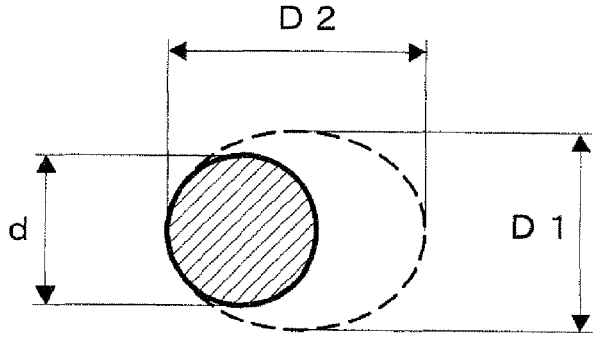
FIG. 4 is an explanatory view of the major axis and the minor axis of a cross-sectional shape of a substantially elliptical spiral curl according to the embodiment of the present invention.
Figure 5:
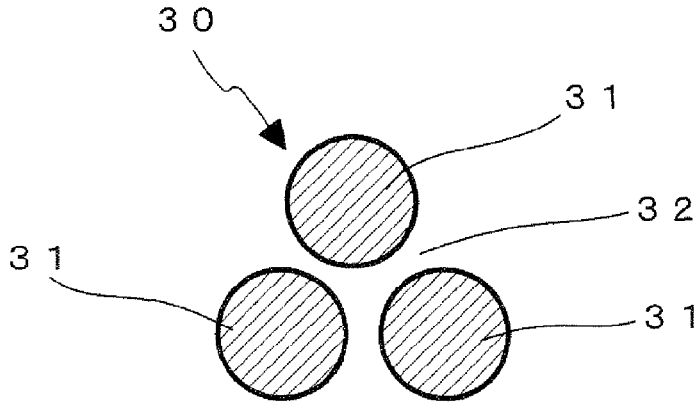
FIG.5 PRIOR ART
FIG. 5 is a cross-sectional view of a conventional steel cord having a 1×3 single-layered twist structure and having an open-twist structure in which all of the wires have very large curls for intertwining.
Figure 6:
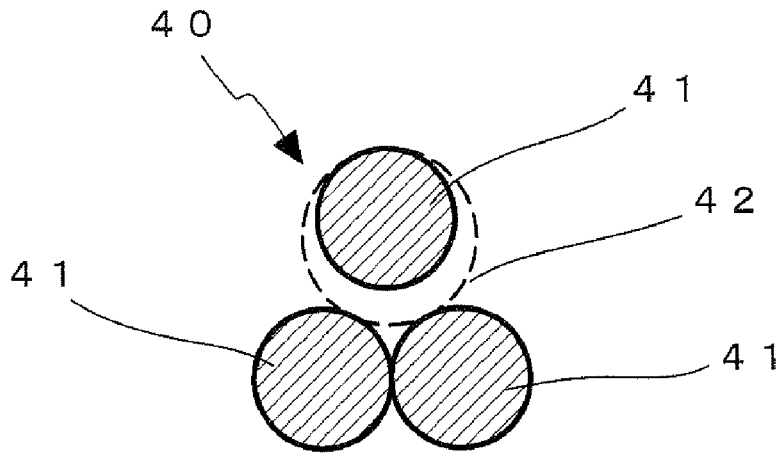
FIG.6 PRIOR ART
FIG. 6 is a cross-sectional view of a conventional steel cord having a 1×3 single-layered twist structure in which one wire has spiral curls that are different from curls for intertwining.
Figure 7:
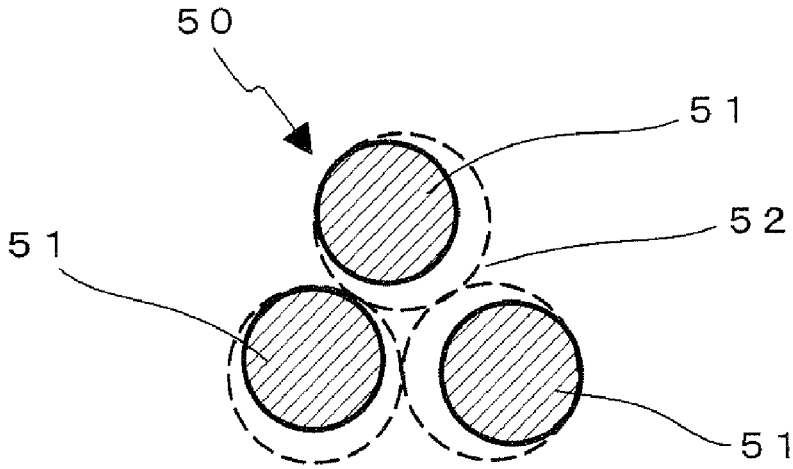
FIG.7 PRIOR ART
FIG. 7 is a cross-sectional view of a conventional steel cord having a 1×3 single-layered twist structure in which all of the wires have spiral curls that are different from curls for intertwining.

The pitch of the substantially elliptical spiral curls of a wire before intertwining is as shown in the plan view in FIG. 3, and refers to the length (pitch) P from a valley to a valley or from a peak to a peak of a wave. As shown in FIG. 4, a minor axis D1 refers to the length in a minor axial direction of a substantially elliptical spiral curl, and a major axis D2 refers to the length in a major axial direction of a cross-sectional shape of a substantially elliptical spiral curl. The curl pitch P (mm) of the substantially elliptical spiral curls before intertwining is 0.32 Pc to 0.55 Pc, where Pc is a twist pitch in mm of a cord, and minor axis D1/major axis D2 is 0.35 to 0.66. Here, the wire diameter d is preferably 0.15 to 0.40 mm. The reason for this is that, if the wire diameter d is less than 0.15 mm, the strength of the steel cord decreases, and, if the wire diameter d is more than 0.40 mm, the flexibility is lowered. The twist pitch Pc is typically 8.0 to 18.0 mm.

In the cord 10, all of the wires 11 have not only curls for intertwining, but also curls having a pitch smaller than that of the curls for intertwining, and, thus, a hollow portion at the center of the cord is in communication with the outside via a gap 12 between the wires 11. Accordingly, rubber material easily penetrates the interior portion.

Furthermore, in the cord 10, all of the wires 11 have curls having a pitch smaller than that of the curls for intertwining, and, when a tension load acts on the cord, the load acts equally on all of the wires 11, and, thus, the fatigue resistance is not lowered by concentration of the load on part of the wires 11, and excellent fatigue resistance is obtained.

Furthermore, in the cord 10, at least any one pair of adjacent wires 11 are substantially in contact with each other at any point in the longitudinal direction of the cord. Accordingly, the cord stretch is reduced, and the low-load stretch can be suppressed.

Another Exemplary Embodiment

Figure 2:
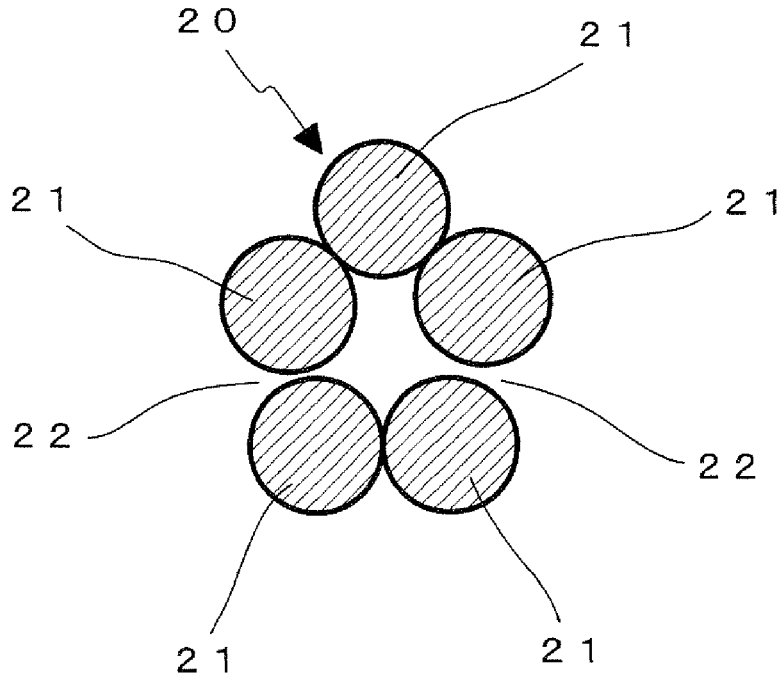
FIG. 2 is a cross-sectional view of a steel cord having a 1×5 single-layered twist structure according to the embodiment of the present invention.

FIG. 2 shows a cross-sectional structure of a steel cord having a 1×5 structure, as another example of an embodiment having a 1×n (n=3 to 6) single-layered twist structure.

A cord (steel cord) 20 shown in FIG. 2 has a 1×5 single-layered twist structure consisting of five wires 21 with the same wire diameter, and is obtained by intertwining the five wires in which all of the wires 21 are provided with substantially elliptical spiral curls (spiral curls having a substantially elliptical cross-section) having a pitch smaller than that of the curls for intertwining, formed by providing the wires with spiral curls and then pressing the wires.

In the cord 20, all of the wires 21 have not only curls for intertwining, but also substantially elliptical spiral curls having a pitch smaller than that of the curls for intertwining. The substantially elliptical spiral curls having a pitch smaller than that of the curls for intertwining are curls obtained by providing the wires with spiral curls, and then pressing the wires. The curl pitch P (mm) of the substantially elliptical curls before intertwining is 0.32 Pc to 0.55 Pc, where Pc is a twist pitch in mm of a cord, and minor axis D1/major axis D2 is 0.35 to 0.66. Here, the wire diameter d is preferably 0.15 to 0.40 mm. The reason for this is that, if the wire diameter d is less than 0.15 mm, the strength of the steel cord decreases, and, if the wire diameter d is more than 0.40 mm, the flexibility is lowered. The twist pitch Pc is typically 8.0 to 18.0 mm.

In the cord 20, all of the wires 21 have not only curls for intertwining, but also curls having a pitch smaller than that of the curls for intertwining, and, thus, a hollow portion at the center of the cord is in communication with the outside via a gap 22 between the wires 21. Accordingly, rubber material easily penetrates the interior portion.

Furthermore, in the cord 20, all of the wires 21 have curls having a pitch smaller than that of the curls for intertwining, and, when a tension load acts on the cord, the load acts equally on all of the wires 21, and, thus, the fatigue resistance is not lowered by concentration of the load on part of the wires 21, and excellent fatigue resistance is obtained.

Furthermore, in the cord 20, at least any one pair of adjacent the wires 21 are substantially in contact with each other at any point in the longitudinal direction of the cord. Accordingly, the cord stretch is reduced, and the low-load stretch can be suppressed.

EXAMPLES

As examples, cords were produced as follows. A steel wire material having a diameter of 5.5 mm was repeatedly subjected to patenting and drawing, the surface was plated with brass, and, thus, wires having a wire diameter of 0.25 mm were obtained. These wires were used to manufacture steel cords having a 1×3 and a 1×5 single-layered twist structure.

Each of the cords having a 1×3 and a 1×5 single-layered twist structure of these examples was obtained by intertwining wires provided with small curls having a substantially elliptical cross-section formed by providing the wires with substantially spiral curls and then pressing the wires.

In all cases, the spiral curls were provided using a curling apparatus (a curling apparatus described in JP S63-63293B) that rotates about supplied wires. The shape of the curls was adjusted with the spacing between curling pins, the size of the curling pins, and the number of times of rotation about the wires.

Furthermore, the pressing step of processing spiral curls into spiral curls having a substantially elliptical cross-section was performed using a known pressing apparatus in which a plurality of freely rotating rollers were arranged in zigzag lines. Note that the pressing means is not limited to this.

The rubber penetration properties, the low-load stretch, the fatigue resistance, the shape stability (twist stability), and the productivity of the thus manufactured cords of the examples were evaluated in comparison with cords of conventional examples.

Evaluation of the rubber penetration properties was performed as follows: each cord was embedded in rubber material under a tension load of 49 N, the resultant was pressed and vulcanized, the cord was taken out of the rubber, the cord was dissembled, a predetermined length was observed, and the ratio of the length in which there was a trace of contact with the rubber with respect to the length subjected to the observation was displayed as a percentage.

Evaluation of the low-load stretch was performed, and stretch under a load of 49 N was displayed as a percentage.

Evaluation of the fatigue resistance was performed as follows: a plurality of cords were embedded in rubber material to form a composite sheet, this sheet was tested using a double-layered belt fatigue testing machine to obtain the number of times the operation was repeated until the cords broke due to fretting wear, buckling, and the like, and the number was displayed as an index number taking cords having a closed-twist structure of the conventional examples as 100.

Evaluation of the handling work efficiency was performed, and a cord having inferior performance was indicated as "Inferior", that having slightly inferior performance as "Slightly Inferior", and that having equivalent performance as "Equivalent", in comparison with the performance of cords having a closed-twist structure of the conventional examples.

Evaluation of the shape stability was performed, and a cord having similar performance was indicated as "Uniform", and that having non-similar performance as "Non-Uniform", using cords having a closed-twist structure of the conventional examples as a reference (Uniform).

Evaluation of the productivity was performed by judging whether or not a wire was broken when subjected to a curling process, and a cord that was not broken was indicated as "Good", and a cord that was broken was indicated as "Bad".

As conventional examples, cords were produced as follows. A steel wire material having a diameter of 5.5 mm was repeatedly subjected to patenting and drawing, the surface was plated with brass, and, thus, wires having a wire diameter of 0.25 mm were obtained. These wires were used to manufacture three types of conventional cords having 1×3 structures consisting of a 1×3 closed-twist structure, a 1×3 open-twist structure, and a 1×3 structure in which part (one) of the wires was provided with spiral curls, and three types of conventional cords having 1×5 structures consisting of a 1×5 closed-twist structure, a 1×5 open-twist structure, and a 1×5 structure in which part (three) of the wires was provided with spiral curls.

Tables 1 and 2 show the evaluation results.

TABLE 1

| | Twist structure | Twist pitch Pc (mm) | Curl pitch P/Pc | Minor axis/major axis D1/D2 | Rubber penetration properties (%) | Low-load stretch (%) | Fatigue resistance | Handling work efficiency | Shape stability | Productivity |
|---|---|---|---|---|---|---|---|---|---|---|
| Conventional Ex. (Close) | 1 × 3 | 12.5 | — | — | 0 | 0.177 | 100 | Equivalent | Uniform | Good |
| Conventional Ex. (Open) | 1 × 3 | 12.5 | — | — | 100 | 0.502 | 105 | Inferior | Non-Uniform | Good |
| Conventional Ex. (Spiral curls) | 1 × 3 | 12.5 | 0.50 | 1.00 | 90 | 0.228 | 98 | Slightly Inferior | Uniform | Good |
| Ex. | 1 × 3 | 12.5 | 0.32 | 0.35 | 100 | 0.238 | 122 | Equivalent | Uniform | Good |
| Ex. | 1 × 3 | 12.5 | 0.36 | 0.40 | 100 | 0.248 | 119 | Equivalent | Uniform | Good |
| Ex. | 1 × 3 | 12.5 | 0.47 | 0.35 | 100 | 0.257 | 112 | Equivalent | Uniform | Good |
| Ex. | 1 × 3 | 12.5 | 0.52 | 0.65 | 95 | 0.287 | 114 | Equivalent | Uniform | Good |
| Ex. | 1 × 3 | 12.5 | 0.54 | 0.52 | 98 | 0.271 | 109 | Equivalent | Uniform | Good |
| Com. Ex. | 1 × 3 | 12.5 | 0.26 | 0.43 | 100 | 0.230 | 105 | Equivalent | Uniform | Bad |
| Com. Ex. | 1 × 3 | 12.5 | 0.30 | 0.35 | 100 | 0.225 | 106 | Equivalent | Uniform | Bad |
| Com. Ex. | 1 × 3 | 12.5 | 0.56 | 0.52 | 70 | 0.316 | 107 | Slightly Inferior | Uniform | Good |
| Com. Ex. | 1 × 3 | 12.5 | 0.47 | 0.69 | 95 | 0.288 | 85 | Equivalent | Non-Uniform | Good |
| Com. Ex. | 1 × 3 | 12.5 | 0.34 | 0.32 | 45 | 0.227 | 85 | Equivalent | Uniform | Good |
| Com. Ex. | 1 × 3 | 12.5 | 0.36 | 0.27 | 40 | 0.231 | 90 | Equivalent | Uniform | Good |
| Com. Ex. | 1 × 3 | 12.5 | 0.56 | 0.67 | 60 | 0.337 | 88 | Equivalent | Uniform | Good |

TABLE 2

| | Twist structure | Twist pitch Pc (mm) | Curl pitch P/Pc | Minor axis/major axis D1/D2 | Rubber penetration properties (%) | Low-load stretch (%) | Fatigue resistance | Handling work efficiency | Shape stability | Productivity |
|---|---|---|---|---|---|---|---|---|---|---|
| Conventional Ex. (Close) | 1 × 5 | 14.0 | — | — | 0 | 0.105 | 100 | Equivalent | Uniform | Good |
| Conventional Ex. (Open) | 1 × 5 | 14.0 | — | — | 100 | 0.588 | 103 | Inferior | Non-Uniform | Good |
| Conventional Ex. (Spiral curls) | 1 × 5 | 14.0 | 0.40 | 1.00 | 85 | 0.199 | 98 | Slightly Inferior | Uniform | Good |
| Ex. | 1 × 5 | 14.0 | 0.32 | 0.38 | 100 | 0.202 | 110 | Equivalent | Uniform | Good |
| Ex. | 1 × 5 | 14.0 | 0.34 | 0.35 | 100 | 0.196 | 110 | Equivalent | Uniform | Good |
| Ex. | 1 × 5 | 14.0 | 0.43 | 0.50 | 100 | 0.227 | 108 | Equivalent | Uniform | Good |
| Ex. | 1 × 5 | 14.0 | 0.49 | 0.58 | 95 | 0.236 | 107 | Equivalent | Uniform | Good |
| Ex. | 1 × 5 | 14.0 | 0.55 | 0.62 | 95 | 0.251 | 105 | Equivalent | Uniform | Good |
| Com. Ex. | 1 × 5 | 14.0 | 0.26 | 0.37 | 100 | 0.197 | 112 | Equivalent | Uniform | Bad |
| Com. Ex. | 1 × 5 | 14.0 | 0.30 | 0.43 | 100 | 0.212 | 110 | Equivalent | Uniform | Bad |
| Com. Ex. | 1 × 5 | 14.0 | 0.58 | 0.52 | 40 | 0.244 | 90 | Equivalent | Uniform | Good |
| Com. Ex. | 1 × 5 | 14.0 | 0.43 | 0.67 | 75 | 0.249 | 81 | Inferior | Non-Uniform | Good |
| Com. Ex. | 1 × 5 | 14.0 | 0.32 | 0.32 | 70 | 0.199 | 102 | Equivalent | Uniform | Good |
| Com. Ex. | 1 × 5 | 14.0 | 0.47 | 0.29 | 50 | 0.216 | 102 | Equivalent | Uniform | Good |
| Com. Ex. | 1 × 5 | 14.0 | 0.60 | 0.29 | 35 | 0.228 | 97 | Equivalent | Uniform | Good |

Tables 1 and 2 clearly show that the cords of the examples are superior to the conventional cords in all evaluations.

Thus, the present invention can be applied to a rubber-product-reinforcing material for an automotive tire, a conveyer belt, or the like.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A rubber-reinforcing steel cord having a 1×n single-layered twist structure obtained by intertwining n wires, where n=3 to 6, with a same wire diameter, wherein all of the wires are provided with substantially elliptical spiral curls having a substantially elliptical cross-section and a pitch smaller than that of curls for intertwining, formed by providing the wires with spiral curls and then pressing the wires, and the substantially elliptical spiral curls have a curl pitch P of 0.32 Pc to 0.55 Pc, where Pc is a twist pitch in mm of a cord, and have a substantially elliptical cross-sectional shape with a minor axis D1/major axis D2 of 0.35 to 0.66.

2. A method for manufacturing a rubber-reinforcing steel cord having a 1×n single-layered twist structure obtained by intertwining n wires, where n=3 to 6, with a same wire diameter, comprising:

providing all of the wires with spiral curls and then pressing the wires to provide the wires with substantially elliptical spiral curls having a substantially elliptical cross-section and a pitch smaller than that of curls for intertwining; wherein the substantially elliptical spiral curls have a curl pitch P of 0.32 Pc to 0.55 Pc, where Pc is a twist pitch in mm of a cord, and have a substantially elliptical cross-sectional shape with a minor axis D1/major axis D2 of 0.35 to 0.66; and intertwining the wires having the substantially elliptical spiral curls into each other to form a steel cord having a single-layered twist structure.

* * * * *